United States Patent [19]

Tochio et al.

[11] Patent Number: 4,988,968

[45] Date of Patent: Jan. 29, 1991

[54] DOUBLE INSULATED TRANSFORMER AND BOBBIN CASE THEREOF

[75] Inventors: Yoshiro Tochio, Tokyo; Satoshi Saito, Nagano; Masaki Hiraide, Nagano; Hideo Konishi, Nagano; Hiroshi Kuwabara, Nagano; Shiro Kokura, Osaka, all of Japan

[73] Assignee: Musashino Tuko Co., Ltd., Nagano, Japan

[21] Appl. No.: 429,229

[22] Filed: Oct. 31, 1989

[30] Foreign Application Priority Data

| | | | |
|---|---|---|---|
| Nov. 1, 1988 | [JP] | Japan | 62-274545 |
| May 25, 1989 | [JP] | Japan | 63-130272 |
| May 25, 1989 | [JP] | Japan | 63-130273 |

[51] Int. Cl.[5] ..... H01F 27/02; H01F 27/30

[52] U.S. Cl. ..... 336/98; 29/606; 220/339; 336/96; 336/192; 336/198

[58] Field of Search ..... 220/339, 20, 22; 206/328, 418; 229/120.19, 120.02, 120.21, 120.22; 217/12 R; 336/198, 208, 90, 192, 96, 98; 29/602.1, 605, 606

[56] References Cited

U.S. PATENT DOCUMENTS

| | | | |
|---|---|---|---|
| 1,124,122 | 1/1915 | Foyle | 206/418 |
| 3,048,323 | 8/1962 | Stauffer | 206/418 X |
| 4,230,227 | 10/1980 | Kowall et al. | 217/12 R X |
| 4,716,394 | 12/1987 | Gordon | 336/192 |

FOREIGN PATENT DOCUMENTS

| | | |
|---|---|---|
| 5042222 | 8/1973 | Japan . |
| 52-92235 | 7/1977 | Japan . |

*Primary Examiner*—Thomas J. Kozma

*Attorney, Agent, or Firm*—Wegner & Bretschneider

[57] ABSTRACT

A bobbin case for use in a transformer of the double-insulated type comprises an insulating member of tube-like shape, a partition wall disposed substantially normal to the axis of the insulating member so that the inner space of said insulating member is divided into two recesses for receiving primary and secondary winding assemblies, respectively, from the opposite directions along the axis of said insulating member, and a pair of insulating rims which extend from the outer end surfaces of the insulating member at the side of the recess for receiving the primary winding assembly. The pair of insulating rims are formed such that they are capable of being bent inwardly along the outer end surfaces so as to obtain a creeping distance between said primary winding and a core inserted into center holes in said winding assemblies. By using the bobbin case, the insertion of the primary and secondary winding assemblies can easily and efficiently be carried out.

A bobbin case according to another aspect of the invention is provided integrally with protecting legs for soldering portions between connected pins and terminal portions of the winding assemblies. The protecting legs are also utilized in hanging a transformer having the bobbin case.

9 Claims, 5 Drawing Sheets

Related Art

Related Art

DOUBLE INSULATED TRANSFORMER AND BOBBIN CASE THEREOF

BACKGROUND OF THE INVENTION

1. Field of the Invention

The present invention relates generally to a transformer of double-insulated type which meets the Standard of IEC (International Electrotechnical Commission), and in particular to a bobbin case of the transformer in which primary and secondary windings are accomodated. The present invention also relates to a method of assembling the double insulated transformer provided with the bobbin case.

2. Related Art Description

A conventional transformer of double-insulated structure comprises a bobbin case into which the primary and secondary winding assemblies are inserted. The bobbin case is comprised of electrically insulated two parts, one for receiving the primary winding assembly and the other for receiving the secondary winding assembly. These two parts are formed integrally by insulating material such as nylons.

A typical bobbin case, primary winding assembly and secondary winding assembly are illustrated in FIGS. 9A to 9C, 10 and 11, respectively. As shown in FIGS. 9A to 9C, the bobbin 1 comprises a first portion 2 for receiving a primary winding assembly and a second portion 3 for receiving a secondary winding assembly. These portions are formed integrally adjacent to each other and are electrically separated by a partition wall 4 therebetween. The second portion 3 has a rectangular recess 3A opened laterally into which the secondary winding assembly 5 shown in FIG. 11 is inserted from the lateral direction. The secondary winding assembly 5 is constituted by a bobbin 5A and a secondary winding 5B around the bobbin 5A. The bobbin 5A is formed with a center hole 5C into which a core is to be inserted. Likewise, the primary winding assembly 6 is constituted by a bobbin 6A having a center hole 6C and a primary winding 6B arround the bobbin 6A, as shown FIG. 10.

While, the first portion 2 has a rectangular recess 2A which is defined by the partition wall 4 and a peripheral wall 2B surrounding the three sides of the partition wall 4. The peripheral wall 2B is formed with two rims 2C and 2D extending inwardly from the vertical edges of the wall 2B. The rims 2C, 2D are provided for obtaining a creeping distance between the primary winding 6A and the core inserted into the ceter holes 5C and 6C. Since these rims 2C and 2D are provided, the primary winding assembly 6 is inserted into the recess 2A through a downward opening 2E of the recess 2A along the vertical direction shown by arrow A in FIG. 12, whereas the secondary winding assembly 5 is inserted into the recess 3A along the horizontal direction shown by arrow B in FIG. 12.

As described above, the directions in which the primary and secondary winding assemblies 5, 6 are inserted into the bobbin case 1 are different from each other, so that whenever winding assemblies are inserted into the bobbin case, it is necessary to determine as to which type the winding assembly to be inserted is and from which direction the winding assembly in question should be inserted into the bobbin case. This causes the inserting operation of the winding assemblies to be complicated and inefficient. In addition, if the inserting operation is intended to carry out automatically, such an assembling device tends to have a complicated mechanism to perform the inserting operations in the different directions.

Furthermore, after the primary winding assembly 6 is inserted, the bobbin case 1 must be maintained such that the opening 2E of the recess 2A is oriented in the upward direction so as not to fall the inserted primary winding assembly 6 from the recess 2A. The core is then inserted into the center holes 5C and 6C with maintaining the bobbin case in this condition. This operation is not easy or efficiently to carry out. In addition, the primary winding assembly 6 after inserted into the recess 2A is exposed at its winding portion 6B through the opening 2E. Therefore, the exposed winding portion must be covered thereafter with insulating tape and the like. This means that additional taping process is needed to assemble the transformer.

As shown in FIG. 12, an E-shaped core assembly 7 is then inserted into the center holes of the assembly 8 of the bobbin case, and the windings and in turn the a flat core assembly 9 is attached to the E-shaped core assembly 7. The resulting assembly is then varnished in order to improve insulation properties of the obtained transformer and to reduce noise in operation of the transformer. The varnish is conducted by means of dipping the transformer into a varnish bath. As shown in FIG. 13, a hanging member 11 is arranged horizontally above a varnish bath 12. The hanging member 11 is provided with several sets of hook members 13A, 13B, hanging therefrom. Each of transformers 10 is hanged on each set of the hook members, and the hanging member 11 is then lowered to dip the hanged transformers 10 into the varnish bath 12. After a predetermined period of time the dipped transformers are pulled out of the bath 12.

This varnishing process is not always employed. For example, if the transformer has no suitable portions the hook members are to be engaged with, it cannot be hanged on the hanging member. In such a case, the varnishing is carried out by placing the transformer in a net and dipping the net into the varnish bath. However, this process is not so efficient as the hanging process.

While, as shown in FIG. 14, the primary and secondary winding assemblies 6 and 5 are provided at their lower ends with external terminals 15, which are joined to connecting pins 16 by soldering. For the purpose of protecting the soldering portions 17 of the respective pins, the conventional bobbin 5 or 6 is provided integrally with protecting legs 18 projecting downwardly from the lower end of the bobbin. Thus, a mold for forming the bobbin with the protecting legs becomes rather complicated. In addtion, the bobbin is formed by comparatively expensive material such as plyethylene, polybutylene-terephthanol, phenol and the like, and so provision of the protecting legs means to increase the manufacturing price of the conventional bobbin.

SUMMARY OF THE INVENTION

Accordingly, an object of the present invention is to provide a novel bobbin case for use in a transformer of the double-insulated type, by which inserting operation of the primary and secondary winding assemblies can easily be carried out.

Another object of the present invention is to provide a bobbin case for use in a transformer of the double-insulated type, which is provided with protecting members for protecting soldering portions of primary and secondary winding assemblies, the protecting portions being also used as portions to be engaged with a hanging member when an assembled transformer is subjected to varnishing.

Still another object of the present invention is to provide a transformer assembly with a novel bobbin case of the present invention.

Yet another object of the present invention is to provide a method of assembling a transformer with a novel bobbin case of the present invention.

In order to accomplish the above and other objects, according to the present invention, a bobbin case for use in a transformer of the double-insulated type is provided which comprises an insulating member of tube-like shape, a partition wall disposed substantially normal to the axis of the insulating member so that the inner space of said insulating member is divided into two recesses for receiving primary and secondary winding assemblies, respectively, from the opposite directions along the axis of said insulating member, and a pair of insulating rims which extend from the outer end surfaces of the insulating member at the side of said recess for receiving said primary winding assembly, said pair of insulating rims being formed such that they are capable of being bent inwardly along said outer end surfaces so as to obtain a creeping distance between said primary winding assembly and a core assembly inserted into center holes in said winding assemblies.

In a preferred embodiment of the present invention, the bobbin case comprises an insulating member of tube-like shape which is provided with protecting legs for protecting soldering portions joining outer connecting pins to the external terminals of the winding assemblies. It is preferable that the protecting legs are formed such that they can be engaged with hook members used for use in hanging and dipping an assembled transformer into a varnish bath.

In another aspect of the present invention, there is provided a transformer assembly which comprises the bobbin case of the present invention.

In another aspect of the present invention, there is provided a method of assembling a transformer of the double-insulated type which includes an E-shaped core block constituted by stacking integrally a plurality of E-shaped core elements, a flat core block constituted by stacking integrally a plurality of flat core elements, and a bobbin case into which primary and secondary winding assemblies are inserted. The bobbin case is formed to have two recesses for receiving the primary and secondary winding assemblies, respectively. The transformer having the bobbin case of the present invention is assembled by the following steps. At first, the E-shaped core block is postioned on a horizontal surfacce such that the three legs of the core block are extending upwardly. The secondary winding assembly is then inserted into the E-shaped core block from the upward direction, and the bobbin case is inserted from the same direction so that the recess facing downwardly receives the winding assembly inserted into the E-shaped core block. Next, the primary winding assembly is inserted into the recess of the bobbin case facing upwardly. Finally, the flat core block is placed on the upper ends of the legs of the E-shaped core block and fixed thereto.

PREFERRED EMBODIMENTS OF THE INVENTION

While the present invention will be described in connection with the preferred embodiments, it will be understood that we do not intend to limit the invention to these embodiments. On the contrary, we intend to cover all alternatives, modifications, and equivalents as may be included within the spirit and scope of the invention as defined by the attached claims.

Figure 1:
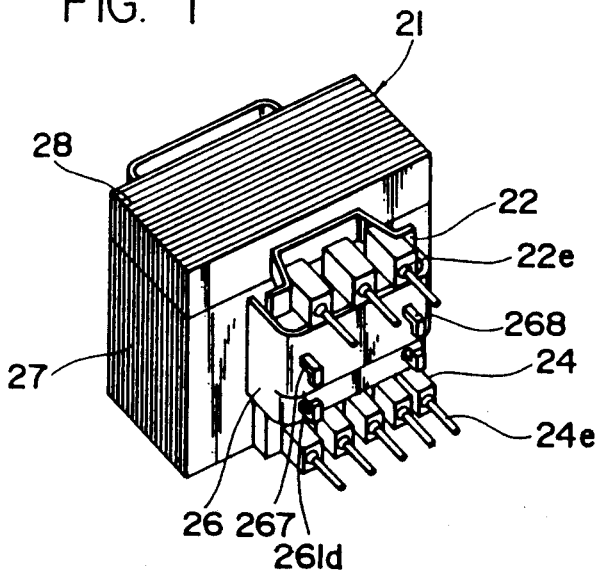
FIG. 1 is a perspective view of the assembled condition of an example of a transformer according to the present invention.
Figure 2:
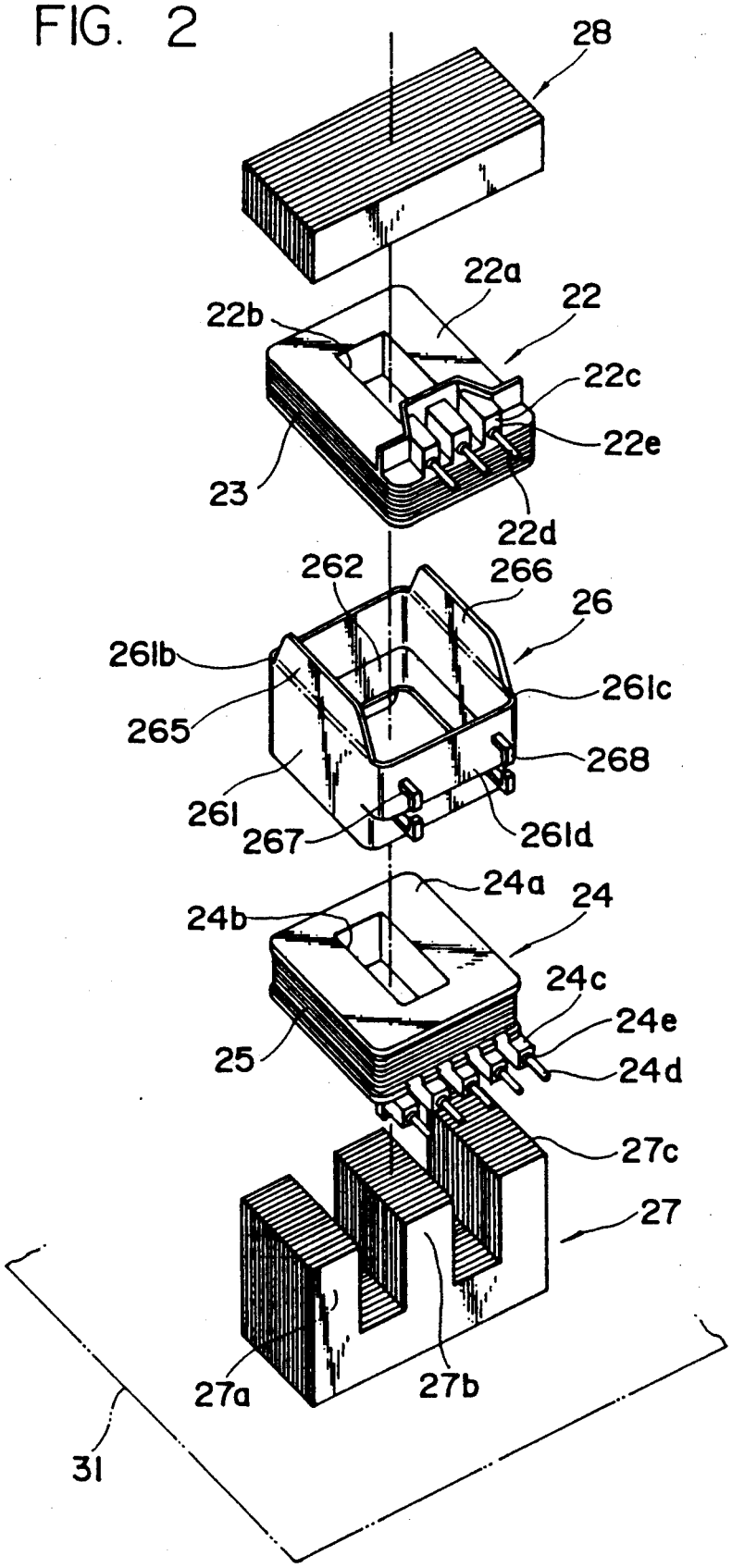
FIG. 2 is an exploded view of the transformer of FIG. 1.

Referring now to the drawings, FIGS. 1 and 2 illustrate a perspective and an exploded views of a transformer of the double-insulated type in accordance with the present invention. As shown in FIGS. 1, 2, the transformer 21 comprises a primary winding assembly 22 having a primary winding 23, a secondary winding assembly 24 having a secondary winding 25, a bobbin case 26 for receiving and holding the primary and secondary winding assemblies 22, 24, an E-shaped core block 27, and a flat core block 28. The primary winding assembly 22 is constituted by a bobbin **22*a* made of insulating material and the primary winding 23 surrounding the outer surface of the bobbin 22*a*. The bobbin 22 is formed with a center hole 22*b* for receiving the middle leg 27*b* of the E-shaped core block 27. The bobbin 22 is also provided with a plurality of terminal portions 22*c*, to which a plurality of outer connecting pins 22*d* are joined by means of soldering portions 22*e*, respectively. The secondary winding assembly 24 is constructed similar to the primary winding assembly 22. That is, it has a bobbin 24***a*, the secondary winding 25, a center hole 24*b*, a plurality of terminal portions 24*c* and a plurality of outer connecting pins 24*d* connected respectively to the terminal portions 24*c* by soldering portions 24*e*. The E-shaped core block 27 is constituted by a plurality of E-shaped core elements of the same size. The E-shaped core elements are stacked and fixed to each other by a suitable means to form the integral E-shaped core block 27. Likewise, the flat core block 28 is constituted by a plurality of flat core elements.

Figure 3A:
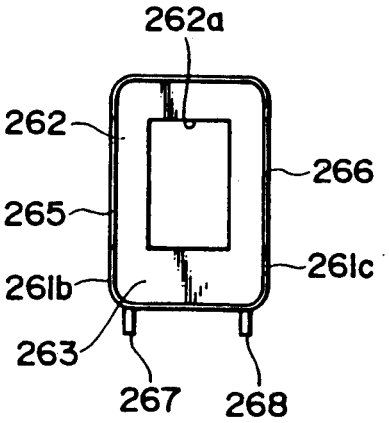
FIG. 3A is a left-side view of an example of a bobbin case for use in the transformer of the double-insulated type of FIG. 1.
Figure 3B:
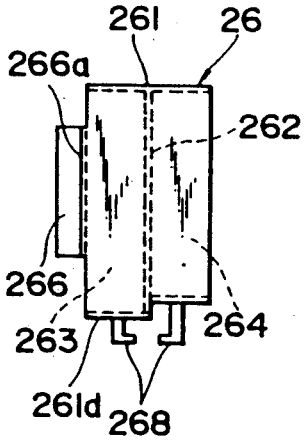
FIG. 3B is a front view of the bobbin case of FIG. 3A.
Figure 3C:
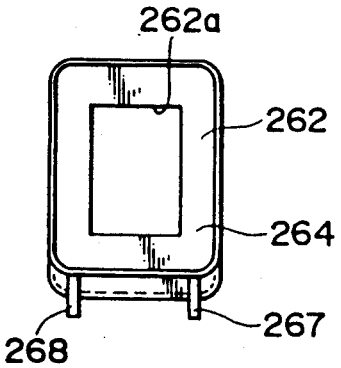
FIG. 3C is a right-side view of the bobbin case of FIG. 3A.
Figure 4:
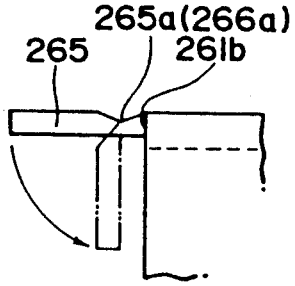
FIG. 4 illustrates a bending structure of each rim of the bobbin case for obtaining a creeping distance between a primary winding and a core of the transformer.

With reference to FIGS. 3A to 3C, the bobbin case 26 will be explained in detail. The bobbin case 26 is mainly formed by an insulating member 261 of tube-like shape with rectangular section. The insulating member 261 is formed in its inner portion with a partition wall 262 which is arranged normal to the axis of the member 261 and divides the inner space of the member 261 into two portions 263 and 264. The portion 263 forms a first recess for receiving the primary winding assembly 22 from one side along the axis of the member 261. Likewise, the other portion 264 forms a second recess for receiving the secondary winding assembly 24 from the opposite side along the axis of the member 261. The partition wall 262 has a through-hole 262*a* at its central portion for receiving the middle leg 27*b* of the E-shaped core block 27. A pair of rims 265 and 266 are formed integrally on the outer end surfaces 261*b* and 261*c* of the first recess 263. The rims 265, 266 are extending from the outer end surfaces along the axis of the tube-like member 261, and are provided with folding lines 265*a* and 266*a* of reduced thickness along the outer end surfaces 261*b* and 261*c* so that they are easily be bent inwardly in a manner as shown in FIG. 4. Alternatively, the rims may be made separately from the tube-like member 261 and attached to the end surfaces 261*b* and 261*c* by any suitable means in such a manner that they are easily bent. The rims 265 and 266 are used for obtaining a creeping distance between the primary winding 23 and the core assembly.

Figure 7:
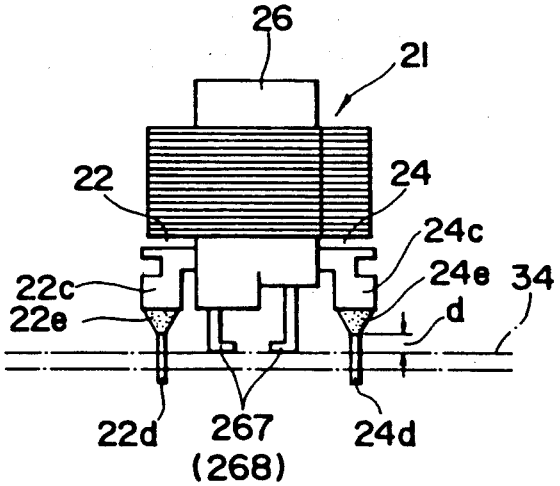
FIG. 7 shows the transformer of FIG. 1 mounted on a printed circuit board.

The bobbin case 26 is also provided integrally with two pairs of protecting legs 267 and 268 projecting perpendicularly from the stepped outer surface 261*d* of the tube-like member 26. Each pair of protecting legs 267, 268 has two legs of L-shaped facing each other. The height of these legs are adjusted such that the top ends thereof are extending beyond the soldering portions 22*e*, 24*e* of the primary and secondary winding assemblies 22, 24 when inserted into the bobbin case 26 (as shown in FIG. 7).

Figure 5:
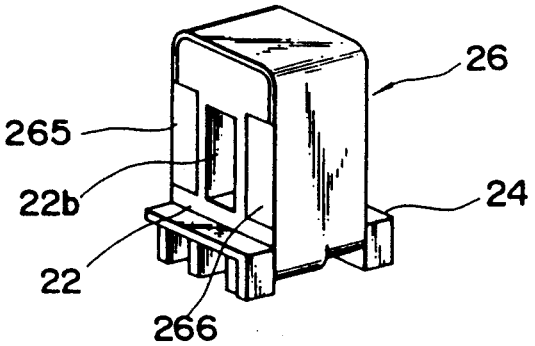
FIG. 5 is a pespective view of the bobbin case in a condition that the primary and secondary winding assemblies are inserted into the bobbin case and the rims are bent inwardly.

The assembling process of the transformer 21 will now be described referring mainly to FIG. 2. Firstly, the E-shaped core block 27 is placed on a horizontal plane 31 in a manner that the three legs 27*a*, 27*b* and 27*c* are facing upwardly. The secondary winding assembly 24 is then mounted on the core block 27 such that the middle legs 27*b* of the core block passes through the center hole 24*b* of the assembly 24. Subsequently, the bobbin case 26 with the second recess 264 being facing downwardly is mounted on the secondary bobbin assembly 24, so that the secondary winding assembly 24 comes into the second recess 264 of the bobbin case 26. Then, the primary winding assembly 22 is inserted into the first recess 263 of the bobbin case 26 opening upwardly, and then the pair of rims 265, 266 are bent inwardly so as to be perpendicular to the tube-like member 261 as shown by a phantom line in FIG. 4. Accordingly, the rims 265 and 266 are placed on the upper end surface of the bobbin 22*a* as shown in FIG. 5. Finally, the flat core assembly 28 is mounted on the side legs 27*a* and 27*c* of the E-shaped core assembly 27 and fixed thereto by a suitable means such as welding or the like. Thus, the assembled transformer 21 as shown in FIG. 1 is obtained.

Figure 12:
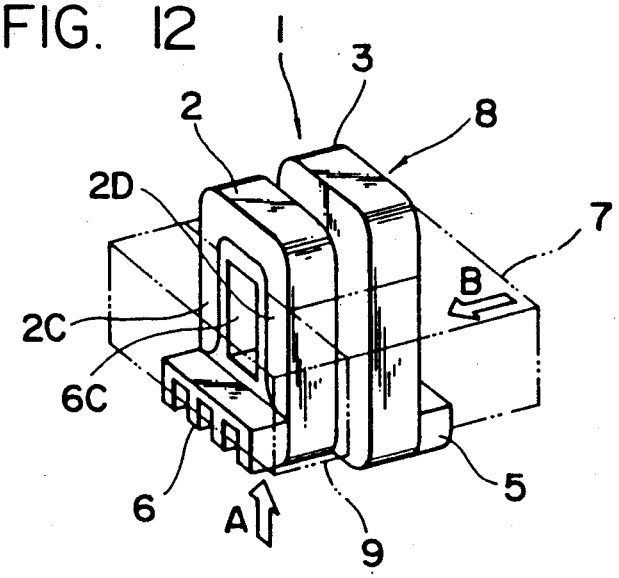
FIG. 12 is a perspective view of the bobbin case of FIG. 9A provided with the primary and secondary winding assemblies of FIGS. 10 and 11.
Figure 13:
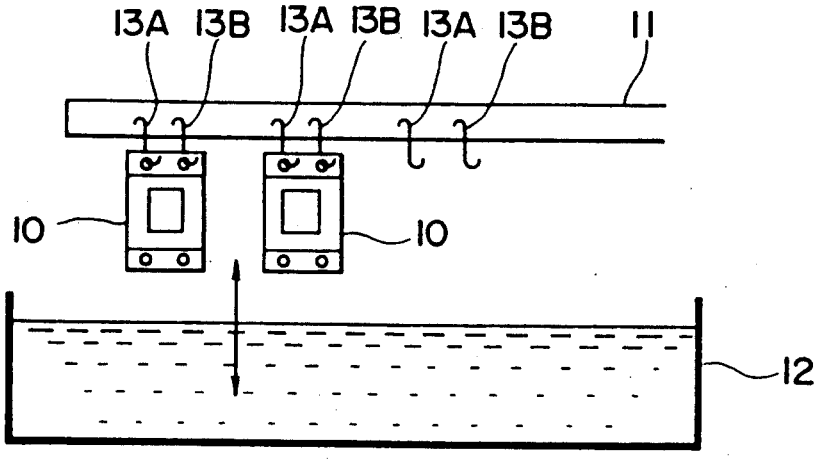
FIG. 13 illustrates dipping process of transformers in a varnish bath.
Figure 14:
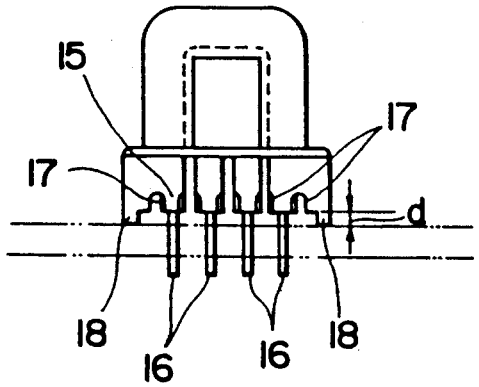
FIG. 14 illustrates protecting legs formed integrally on the primary and secondary winding assemblies.

As described above, in the present embodiment, the bobbin case 26 is formed such that the primary and secondary winding assemblies 22 and 24 can be inserted into the first and second recesses 263 and 264, respectively, from the opposite directions along the axis of the bobbin case 26. Hence, the inserting operation of the primary and secondary winding assemblies into the bobbin case can easily be carried out in an efficient way in comparison to the conventional operation wherein the inserting directions of the winding assemblies are different as shown in FIG. 12. In addition, since the assembling operation can be carried out from one direction along the axis of the bobbin case as shown in FIG. 2, automation of such operation can easily be performed.

Figure 6:
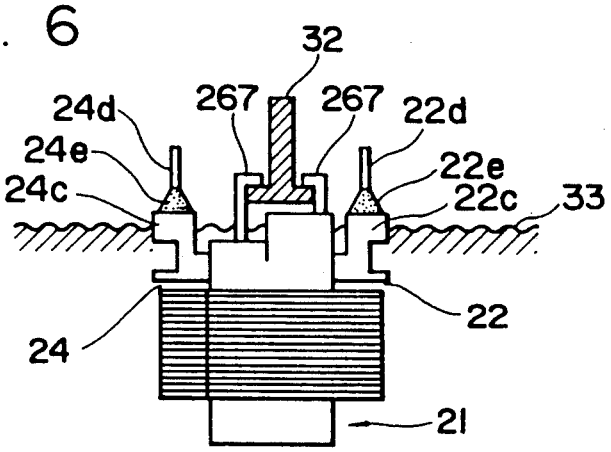
FIG. 6 show a dipped condition of the transformer of FIG. 1 in to a varnishing bath.

Next, the assembled transformer 21 is usually subjected to varnish in order to improve its insulation properties, noise reduction properties and the like. The transformer 21 is provided with two pair of protecting legs 267 and 268 projecting from the bobbin case 26 at the side where the connecting pins 22*d* and 24*d* are projecting in the same direction. Therefore, in the varnish of the trasnformer 21, hook members 32 are engaged with the protecting legs 267 and 268 to thereby hang the transformer from the hook members 32, as shown in FIG. 6. The hanged transformer 21 is then dipped into the varnish bath 33 for a predetermined period of time. Thus, the protecting legs can be utilized in hanging the transformer 21, so that the varnish process can easily be carried out.

The varnished transformer 21 is then mounted on a predetermined place of a printed circuit board 34 in a manner that the connecting pins 22*d* and 24*d* are facing downwardly. In this condition, as shown in FIG. 7, the protecting legs 267 and 268 are projecting in the same direction and are extending beyond the soldering portions 22*e* and 24*e* of the pins 22*d* and 24*d* by a distance of d. Thus, the lower ends of the protecting legs 267 and 268 are seated on the board, which prevent the soldering portions 22*e* and 24*e* from touching the board.

Figure 8:
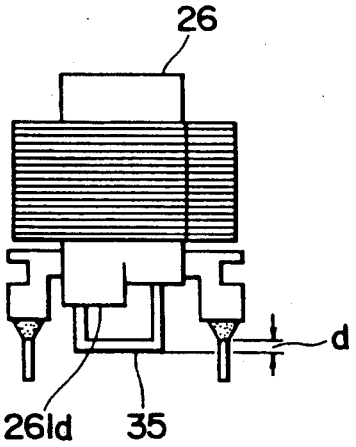
FIG. 8 shows another embodiment of the bobbin case having a closed protecting legs.
Figure 9A:
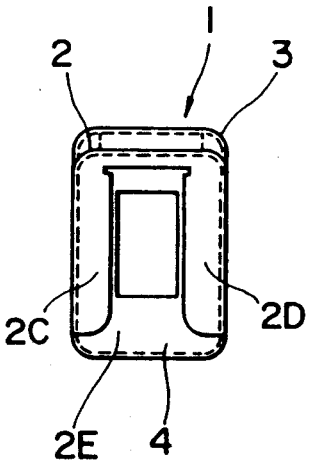
FIG. 9A is a left-side view of the bobbin case for use in a conventional transformer of the double-insulated type.
Figure 9B:
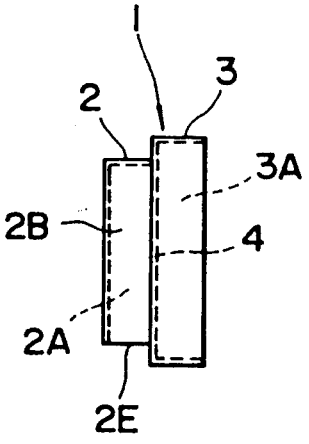
FIG. 9B is a front view of the bobbin case of FIG. 9A.
Figure 9C:
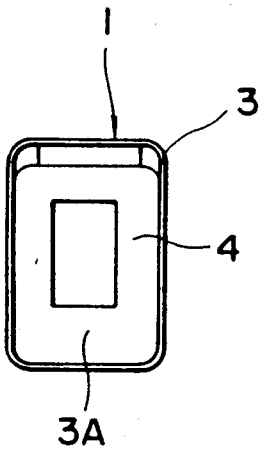
FIG. 9C is a right-side view of bobbin case of FIG. 9A.
Figure 10:
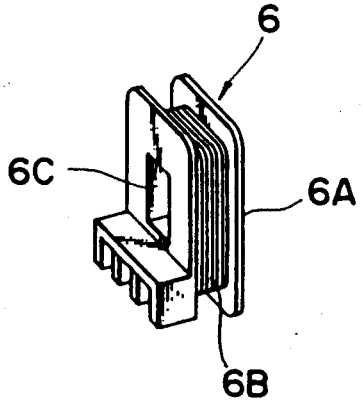
FIG. 10 is a perspective view of the primary winding assembly provided in a transformer of the double-insulated type.
Figure 11:
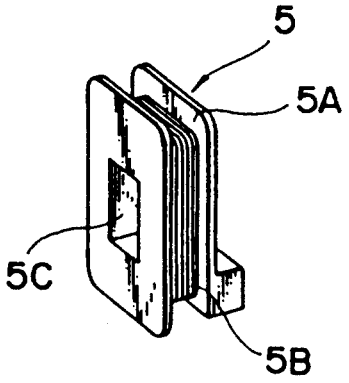
FIG. 11 is a perspective view of the secondary winding assembly provided in a transformer of the double-insulated type.

FIG. 8 illustrates another example of the protecting legs, wherein protecting leg is from a U-shaped member 35, both ends of which are connected integrally to the stepped outer surface 261*d* of the bobbin case.

Other aspects, objects, and advantages of the present invention can be obtained from a study of the specification, the drawings, and the appended claims.

We claim:

1. A transformer of the double-insulated type, comprising a bobbin case disposed therein, said bobbin case comprising an insulating member of tube-like shape, a partition wall disposed substantially normal to a longitudinal axis of the insulating member so that the inner space of said insulating member is divided into two recesses receiving primary and secondary winding assemblies from the opposite directions along the axis of said insulating member, and a pair of insulating rims projecting from the outer end surfaces of said insulating member at the side of said recess for receiving said primary winding assembly, said pair of insulating rims being formed such that they are capable of being bent inwardly along said outer end surfaces so as to obtain a creeping distance between a primary winding of said primary winding assembly and a core assembly of the transformer attached to said winding assemblies.

2. The transformer as set forth in claim 1, wherein said insulating member is provided with protecting legs integrally for protecting soldering portions between external terminals of said winding assemblies and secondary windings and outer connecting pins connected thereto, said protecting legs being desinged to project beyond said soldering portions by a predetermined distance.

3. The transformer as set forth in claim 2, wherein said protecting legs are formed such that they are capable of being engaged with a hanging means for use in dipping the transformer into a varnish bath.

4. A transformer of the double-insulated type comprising a primary winding assembly which has a primary winding surrounding a bobbin with terminal portions to which outer connecting pins are connected, a secondary winding assembly which has a secondary winding surrounding a bobbin with terminal portions to which outer connecting pins are connected, a bobbin case for receiving and holding the primary and secondary winding assemblies, an E-shaped core block made from a plurality of E-shaped core elements, and a flat core block made from a plurality of flat core elements, said bobbin case being provided with protecting legs integrally for protecting soldering portions between said terminal portions of said winding assemblies and said connecting pins, and said protecting legs being designed to project beyond said soldering portions by a predermined distance.

5. The transformer as set forth in claim 4, wherein said protecting legs are formed such that they are capable of being engaged with a hanging means for use in dipping the transformer into a varnish bath.

6. A transformer of the double-insulated type comprising a primary winding assembly which has a primary winding surrounding a bobbin with terminal portions to which outer connecting pins are connected, a secondary winding assembly which has a secondary winding surrounding a bobbin with terminal portions to which outer connecting pins are connected, a bobbin case for receiving and holding the primary and secondary winding assemblies, an E-shaped core block made from a plurality of E-shaped core elements, and a flat core block made from a plurality of flat core elements; and, wherein said bobbin case comprises an insulating member of tube-like shape, a partition wall disposed substantially normal to the axis of the insulating member so that the inner space of said insulating member is divided into two recesses for receiving said winding assemblies, respectively, from the opposite directions along the axis of said insulating member, and a pair of insulating rims projecting from the outer end surfaces of said insulating member at the side of said recess for receiving said primary winding assembly, said pair of insulating rims being formed such that they are capable of being bent inwardly along said outer end surfaces so as to obtain a creeping distance between said primary winding and the portion of said E-shaped core block.

7. The transformer as set forth in claim 6, wherein said insulating member of the bobbin case is provided with protecting legs integrally for protecting soldering portions between said terminals of the winding assemblies and said connecting pins, said protecting legs being desinged to project beyond said soldering portions by a predetermined distance.

8. The transformer as set forth in claim 7, wherein said protecting legs are formed such that they are capable of being engaged with a hanging means for use in dipping the transformer into a varnish bath.

9. A method of assembling a transformer of the double-insulated type, wherein said transformer comprises a primary winding assembly having a primary winding, a secondary winding assembly having a secondary winding, a bobbin case for receiving and holding the primary and secondary winding assemblies, an E-shaped core block made from a plurality of E-shaped core elements, and a flat core block made from a plurality of flat core elements, and wherein said bobbin case is constituted by an insulating member of tube-like shape, a partition wall disposed substantially normal to the axis of the insulating member so that the inner space of said insulating member is divided into two recesses for receiving said primary and secondary winding assemblies, respectively, from the opposite directions along the axis of said insulating member, and a pair of insulating rims projecting from the outer end surfaces of said insulating member at the side of said recess for receiving said primary winding assembly, said pair of insulating rims being formed such that they are capable of being bent inwardly along said outer end surfaces so as to obtain a creeping distance between said primary winding and the portion of said E-shaped core block, comprising the steps of:

placing said E-shaped core block on a plane in a manner that the three legs thereof are facing upwardly;

inserting said secondary winding assembly into said E-shaped core block from upward direction;

inserting said bobbin case into the assembled secondary winding assembly from upward direction in a manner that the recess for receiving the secondary winding assembly is facing downwardly in order to receive the secondary winding assembly therein;

inserting said primary winding assembly into the upwardly facing recess of the assembled bobbin case;

bending said pair of rims inwardly to the extent that they are substantially parpendicular to the axis of the bobbin case, and;

placing said flat core block on the top surfaces of the side legs of the E-shaped core assembly and fixed thereto.

* * * * *